United States Patent [19]

Haseley et al.

[11] Patent Number: 5,054,995

[45] Date of Patent: Oct. 8, 1991

[54] APPARATUS FOR CONTROLLING A FLUID COMPRESSION SYSTEM

[75] Inventors: Robert K. Haseley, Mooresville; Paul A. Kirkpatrick, Charlotte, both of N.C.

[73] Assignee: Ingersoll-Rand Company, Woodcliff Lake, N.J.

[21] Appl. No.: 432,115

[22] Filed: Nov. 6, 1989

[51] Int. Cl.[5] ..... F01D 17/00; F01D 19/00; F01D 21/00

[52] U.S. Cl. ..... 415/17; 415/26; 415/47; 417/19; 417/32; 340/825.07; 364/138

[58] Field of Search ..... 415/13, 17, 26, 15, 415/47, 49, 51, 16, 27, 28; 417/18, 19, 32, 26, 28; 364/188, 138, 509, 510; 340/825.06, 825.07, 825.08

[56] References Cited

U.S. PATENT DOCUMENTS

| | | | |
|---|---|---|---|
| 3,574,474 | 4/1971 | Lukacs | 415/15 |
| 3,689,197 | 9/1972 | Berle et al. | 417/18 |
| 3,860,363 | 1/1975 | Silvern et al. | 417/26 |
| 3,876,326 | 4/1975 | Weitz | 415/17 |
| 3,963,367 | 6/1976 | Stalker et al. | 415/17 |
| 4,005,581 | 2/1977 | Aanstad | 415/17 |
| 4,156,578 | 5/1979 | Agar et al. | 415/17 |
| 4,227,862 | 10/1980 | Andrew et al. | 417/18 |
| 4,236,379 | 12/1980 | Mueller | 417/32 |
| 4,336,569 | 6/1982 | Tsuda et al. | 361/395 |
| 4,413,314 | 11/1983 | Slater et al. | 364/138 |
| 4,439,997 | 9/1984 | Cantley | 417/2 |
| 4,535,401 | 8/1985 | Penn | 364/138 |
| 4,595,342 | 6/1986 | Christlieb et al. | 417/45 |
| 4,646,528 | 3/1987 | Marcade et al. | 62/127 |
| 4,652,976 | 3/1987 | Fushimoto | 361/413 |
| 4,671,097 | 6/1987 | Kurki et al. | 364/510 |
| 4,706,470 | 11/1987 | Akazawa et al. | 62/209 |
| 4,788,447 | 11/1988 | Kiyono et al. | 307/10 R |
| 4,791,258 | 12/1988 | Youtz et al. | 200/302.1 |
| 4,807,150 | 2/1989 | Hobbs | 417/19 |
| 4,831,535 | 5/1989 | Blotenberg | 415/17 |
| 4,899,338 | 2/1990 | Wroblenski | 370/85.1 |
| 4,968,218 | 11/1990 | Koivula et al. | 417/26 |

FOREIGN PATENT DOCUMENTS

| | | | |
|---|---|---|---|
| 3213155 | 4/1982 | Fed. Rep. of Germany . | |
| 0048999 | 3/1987 | Japan | 415/13 |
| 2223331 | 4/1990 | United Kingdom . | |

*Primary Examiner*—Edward K. Look
*Assistant Examiner*—Hoang Nguyen
*Attorney, Agent, or Firm*—Glenn B. Foster

[57] ABSTRACT

An apparatus includes a compressor for compressing fluid including a sensor capable of sensing at least one function relative to the operation of the compressor. A controller controls the compressor causing the value of said one function to be within a predetermined parameter. A computer overrides the independent response of the controller wherein the controller acts in response to the computer, the computer being separate from said controller. The computer may act as a sequencing computer or as a test computer.

27 Claims, 3 Drawing Sheets

APPARATUS FOR CONTROLLING A FLUID COMPRESSION SYSTEM

BACKGROUND OF THE INVENTION

This invention relates generally to electronic controls, and more particularly to an electronic control which is used to control and monitor the operation of fluid compression means such as a compressor or pump.

Previously, fluid compression means have been controlled by electromechanical means. Even though these control means could display the pressure and temperature of the fluid compression means, they could not respond with reliable accuracy or display the pressure or temperature situation prior to an undesired shutdown of the compressor or pump.

In particular, prior controls for air compressors suffered from the limitations that they could not be operated from a sequencing computer operating over a single line. Also, there was no way to insert a code into the language input to the controls such that the controls would respond to only the correct signals. The prior controls could not have a simulated signal inserted thereinto for the purpose of testing response to simulated parameters.

The foregoing illustrates limitations known to exist in present devices and methods. Thus, it is apparent that it would be advantageous to provide an alternative directed to overcoming the limitations set forth above. Accordingly, a suitable alternative is provided including features more fully disclosed hereinafter.

SUMMARY OF THE INVENTION

In one aspect of the present invention, this is accomplished by providing an apparatus including a compressor for compressing fluid including a sensor capable of sensing at least one function relative to the operation of the compressor. A controllable controls the compressor causing the value of said one function to be within a predetermined parameter. A computer overrides the independent response of the controller wherein the controller acts in response to the computer, the computer being separate from said controller.

The foregoing and other aspects will become apparent from the following detailed description of the invention when considered in conjunction with the accompanying drawing. It is to be expressly understood, however, that the drawing figures are not intended as a definition of the invention, but are for the purpose of illustration only.

DETAILED DESCRIPTION

Figure 1:
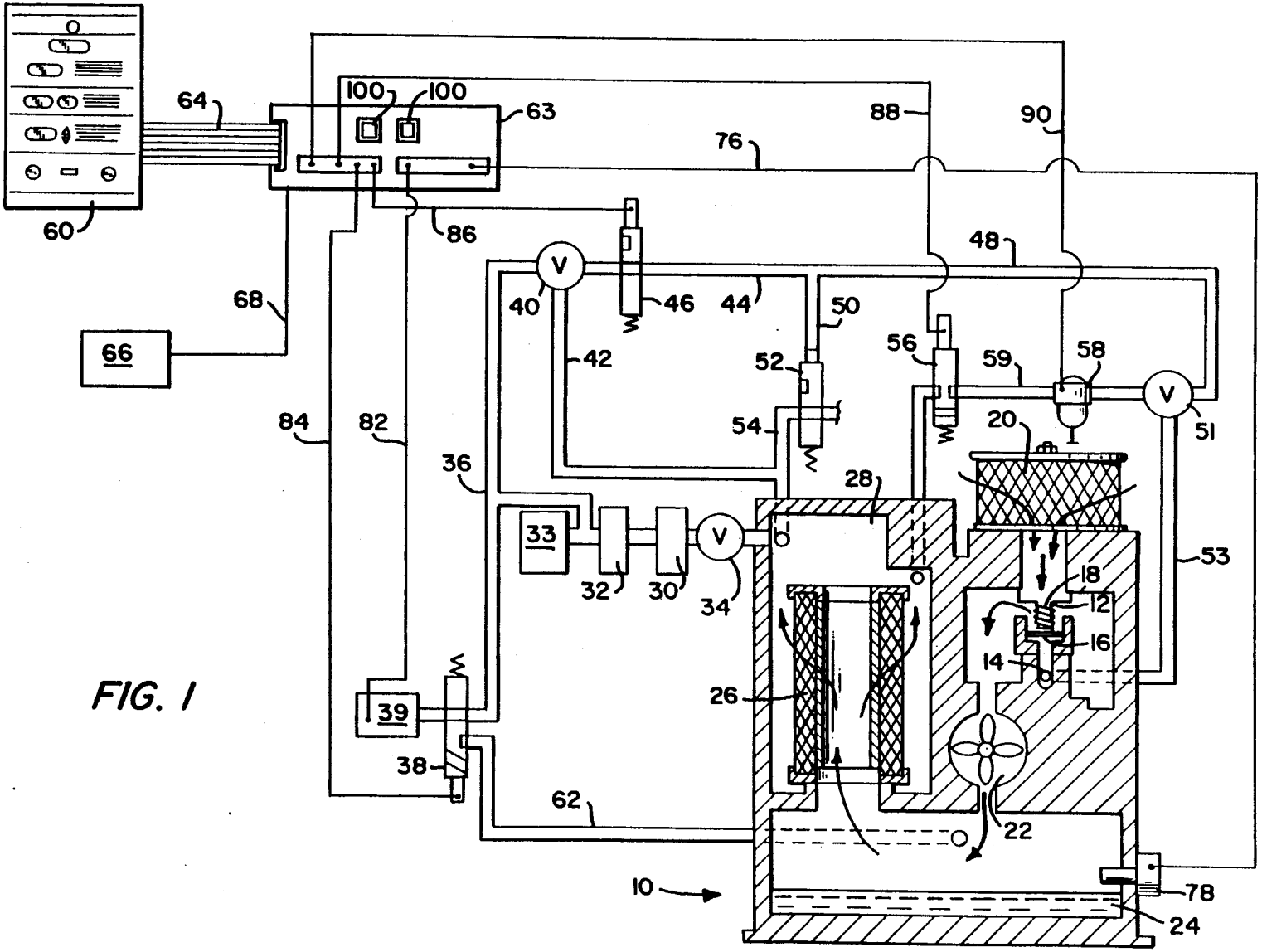
FIG. 1 is a schematic view illustrating an embodiment of a compressor, with the associated tubing and electrical wiring utilized to operate the compressor, including valves displayed as they would appear in an unloaded state.

Referring now to the drawings, FIGS. 1,2,3, and 4 illustrate an embodiment of the control system for an air compressor of the instant invention. Similar elements are identically numbered throughout the figures.

It is to be understood that while portions of the specification refer to an air compressor, the controller of the instant invention could be similarly applied to pumps, or any other machine which produces compressed air.

Piping System

A compressor controlled by a controller 60 of the instant invention is shown generally at 10. An inlet valve 12 is closed whenever the pressure in an inlet port 14 exerts a pressure on piston 16 which overcomes spring 18. All the air entering the inlet valve has passed through air filter 20. The air which has passed through the inlet valve is propelled by a compressor rotor or driver 22 into compressor sump 24.

The compressor rotor 22 may be rotary, axial, or any other well known type. Oil is used both to cool and lubricate the rotor 22, and is collected in the sump 24. A separator filter 26 removes the oil from the air which has passed through the rotor 22 into the sump 24. Air which has passed through the filter 26 enters a compressor discharge 28. The discharge 28 is connected via a minimum pressure check valve 34, an aftercooler 30 and a moisture separator 32 to a user of the compressed air 33. The minimum pressure check valve 34 maintains the pressure in the compressor at a certain pressure (for example 30 psi).

The piping system relates to the compressor as follows: The pressure line 36 is connected to, and contains the same pressure as the compressor discharge 28. Pressure line 36 connects a line/sump solenoid valve 38 to a shuttle valve 40. Line 42 connects the compressor discharge 28 to the solenoid valve 40. A line 44, which incorporates unload solenoid valve 46, branches into a blowdown line 50 and a line 48. Blowdown line 50, when pressurized, opens a blowdown valve 52 and permits the pressure contained within the compressor discharge 28 to escape via a vent line 54 to the atmosphere.

The vent line 54 may optionally be connected through the air filter 20 to limit the noise of air escaping from the discharge 28. If the vent line is connected to the filter, however, then a blowdown orifice, not shown, should be included to limit the reverse passage of oil which would otherwise travel from the inlet area to the discharge.

The line 48 connects via shuttle valve 51 to input valve line 53. A modulating line 59, incorporating a modulating solenoid valve 56 and a modulating adjusting valve 58, connects the compressor discharge 28 to the shuttle valve 51. Whichever line 48 or 59 has the greatest pressure will be connected to the input valve line 53.

A pressure sensor 39 monitors the pressures of line 36 and sump line 62, as controlled by the line/sump solenoid valve 38. The controller switches the position of the solenoid valve 38 several times a second such that both the individual line pressures, and the difference between the two pressures, can be accurately determined. The operation of the controller 60 with respect to the line/sump solenoid valves will be described later in this specification.

Piping Operation

The compressor 10 and the associated components of the instant invention may be operated in three modes: unloaded, on line/off line, and modulate. The unloaded mode is preferred during the start up of the compressor and when it is desired to limit the output air of the compressor. The on line/off line mode is preferred when the compressor is experiencing a widely varying air demand, as occurs when the user is using an air tool intermittently. The modulate mode is preferably used in those instances where the compressed air demand relative to the compressor capacity is relatively high.

In the unloaded mode, the compressor will not be displacing any air since the inlet valve 12 will be closed. The controller 60 will open the unload solenoid valve, causing the discharge pressure in pressure line 36 to be applied through line 44 to the line 48 and the blowdown line 50. The pressure in blowdown line 50 will open blowdown valve 52, venting the pressure in the discharge 28 via vent line 54 to the atmosphere. Concurrently, the pressure in line 48 will pass through valve 51 and line 53 to inlet port 14, causing the inlet valve 12 to be closed.

In the on line/off line mode the unload valve 46 will be closed, causing the inlet valve to open permitting the compressor to displace air, and causing the blowdown valve 52 to close preventing the venting of the compressor discharge 28 to the atmosphere. However the compressor itself may be shut down to prevent the passage of air through the compressor during the off line mode.

In the modulate mode, the controller will still deactivate the unload valve as described in the prior paragraph, but the modulating solenoid valve 56 will be open. The pressure in compressor discharge 28 will be applied through the modular line 59, the valve 56, and the modular adjustment valve 58 (where the operator may adjust the pressure via the controller). The discharge pressure will be adjusted by the modular adjustment valve 51 and applied to input line 53 and the inlet port 14 via valve 51. The pressure at which the inlet valve will open will be controlled by the controller.

Electrical System

The controller 60 indicates which functions and parameters of compressor 10, such as temperature and pressure, the operator may select to be displayed, quantitatively displays those functions and parameters, sets the limits of the parameters, and controls the compressor 10 if the parameters exceed the limits. The following elements are used in the operation of the controller 60.

The controller 60 transmits all of the information to a printed circuit board 63 via conductor cable 64. Power is applied to the controller 60 from a voltage source 66 via a conductor 68 and conductor cable 64.

There are several inputs to the printed circuit board 63. Conductor 76 connects a thermistor 78 to the board 63.

Since the computer feeds signals to the controller which is utilized by the controller, the operation of the controller can be tested by applying a signal having known parameters from the computer to the controller. If the controller responds appropriately to the known signal, then the controller is acceptable for that specific parameter. Otherwise the controller is not operationally acceptable. Thermistor 78 is connected to the sump 24. This thermistor detects the discharge temperature since the temperature at the sump equals the temperature at the discharge 28.

A conductor 82 connects the printed circuit board to the pressure sensor 39, and senses the pressures of both the compressor sump 24 and the compressor discharge 28. The controller monitors temperature and both pressures at both locations several times a second, to ensure that none of the functions exceed a preset limit (either set by the operator or the manufacturer).

There are also several outputs from the controller 60, through conductor tape 64 and the printed circuit board 63 which control the operation of the compressor 10. A conductor 84 connects the board 63 to the solenoid valve to control whether the pressure sensor will read the sump 24 pressure or the discharge 28 pressure.

A conductor 86 connects the board to the unload solenoid valve 46 to control when the valve 46 will open and cause the compressor to enter an unloaded state. When the unloaded valve opens, the blowdown valve 52 will open, venting the pressure in the compressor discharge 28 and line 42 to the atmosphere.

A conductor 88 connects the board 63 to the modulating solenoid valve 56. When the controller 60 activates valve 56, the compressor will go into the modulating mode, the inlet valve will be controlled by the modular adjustment valve 58. Valve 58 connects to board 63 via conductor 90. In this manner, the controller not only determines the operating conditions of the compressor, but also controls the operation of the compressor.

Controller Operation

Figure 2:
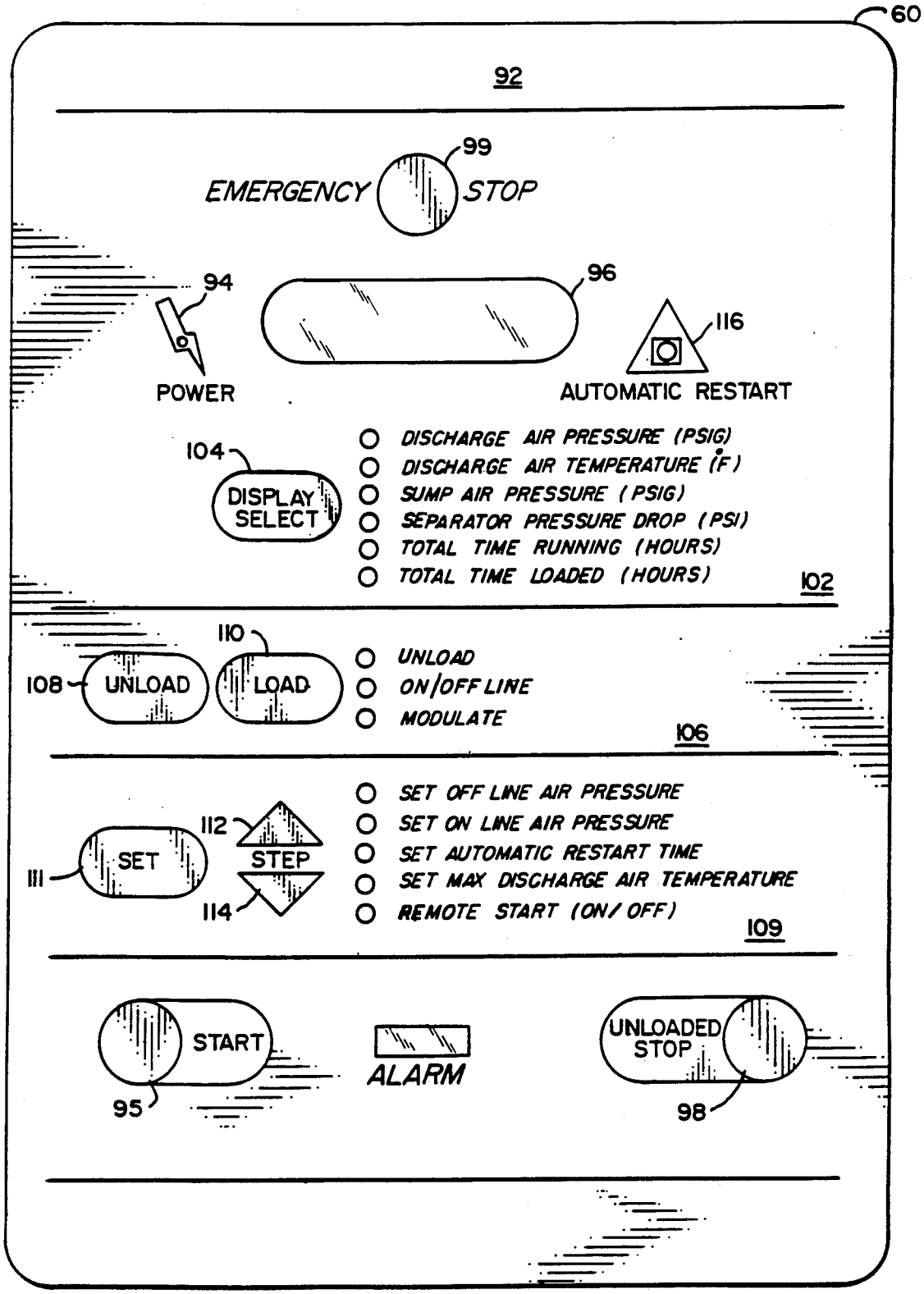
FIG. 2 is a front view illustrating an embodiment of the controller panel of the instant invention including various controller parameters and controller functions.
Figure 4:
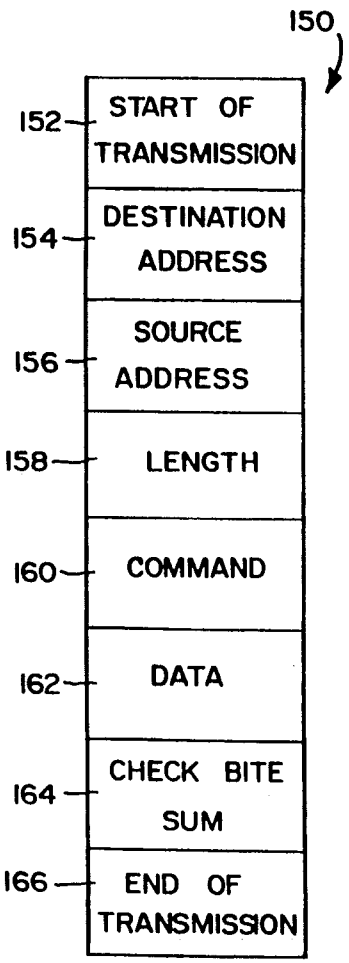
FIG. 4 is a block diagram illustrating an embodiment of the arrangement of the computer commands given to the controllers.
Figure 3:
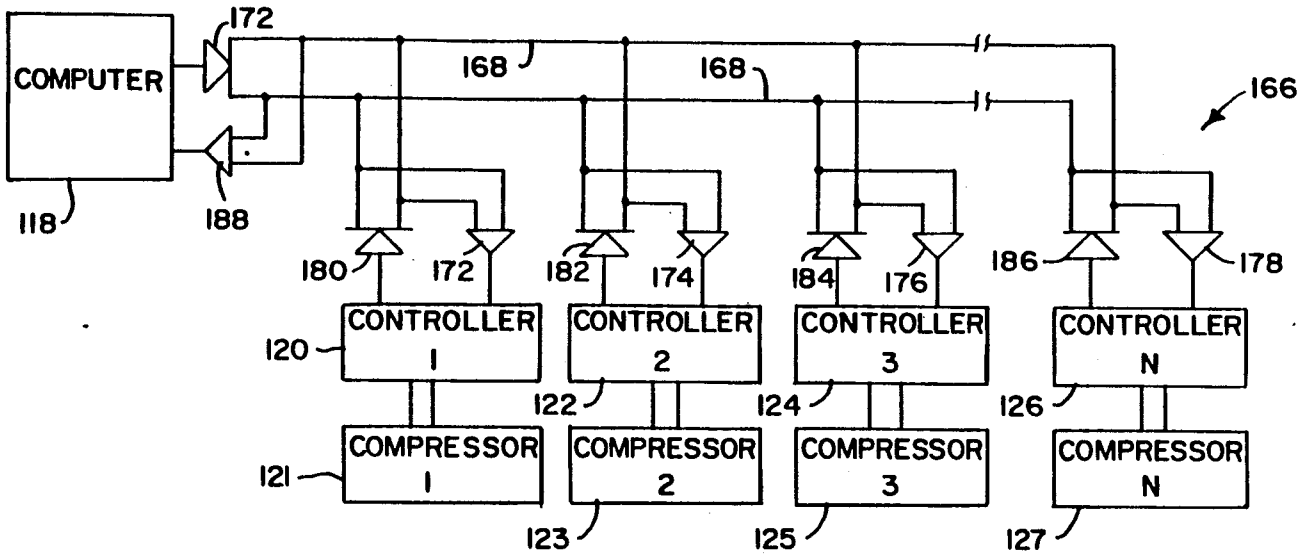
FIG. 3 is a schematic diagram illustrating an embodiment of the electrical connections of a plurality of controllers with their compressors to the computer which controls the controllers and compressors.

A faceplate 92 of the controller 60 is shown in FIG. 2. A power indicator to the controller is shown as 94, and the compressor may be powered by pressing a start switch 95. The controller may be placed in the unloaded condition and then stopped by pressing an unloaded stop switch 98. If there is some reason why the compressor must be stopped instantly, then an emergency stop switch 99 may be pressed.

A graphic display 96, such as an LED, is used to display the controller parameters. The parameters are considered as those characteristics which are not controllable by the controller during the operation of the compressor. The parameters 102 shown on the controller of FIG. 2 include operating outlet and sump pressures, difference between the inlet and the sump pressures, total time which the compressor has been running, total time in which the compressor has been running in an unloaded state, and the compressor discharge temperature.

The graphic display 96 is also used to display the maximum set point of all functions 109. The functions are performed by the controller 60 during the operation of the compressor, and include the set on and off line air pressures, the automatic restart time, the maximum discharge air temperature, and the remote start. The operation of these functions will be described latter in the specification.

The controller has the capabilities to have a memory and an associated printout. In those instances where the compressor 10 shuts itself off since one of the functions was exceeded but the user is unsure which function it was, the user can analyze the printout to determine which function was exceeded.

The controller 60 also has a timing capability integral with the printed circuit board 63. Therefore, the controller has the ability to determine how long the compressor has been operating in total and how long the compressor has been operating in an unloaded state.

The controller 60 also has a modular section 106, by which the mode in which the controller is operating in can be controlled. Due to the timing circuit, the controller 60 has the capability of determining which is the best mode of operation for the compressor to be operating under considering the present state of operation. If the controller is in the on line/off line mode, and the compressor switches between the on and off line positions an established number of times within a specified period (for example three times within three minutes), then the controller will default the compressor to the modulate mode, which would be more suitable considering the operation of the compressor.

The controller has an unloaded stop switch 98 to place itself in an unloaded condition prior to the time that the compressor fully stops. It is greatly preferred that a compressor be stopped in the unloaded state since if the compressor stops with any pressure in the sump 24, damage could result to the rotors 22 by the pressure in the sump 24 attempting to escape through the rotors. The unloaded stop switch 98 operates by turning the compressor to the unloaded state a short period (for example seven seconds), before the compressor is turned off.

If there is some reason why the operator wishes to instantly turn the compressor off, then there is an emergency off switch 99 which turns the machine off in its loaded state.

A single pressure transducer or sensor 39 is used to measure more than one pressure since the line/sump solenoid valve switches the pressure which is applied to the transducer input between pressure lines 36 and 62. Previously, two pressure sensors were required to read the pressures. This multiplicity of pressure sensors not only lead to increased expense, but also to inconsistent readings.

The controller 60 also has the capability of calibrating the pressure in the transducer 39 to a known pressure setting. If the transducer is reading a known pressure setting and indicating an incorrect reading, then the controller pressure display can be raised or lowered that amount. The thermistor 78 can be similarly calibrated. This not only is helpful to adjust an inaccurate transducer, but also to calibrate the setting when the compressor is brought to a location with a different pressure (due to high altitude, etc.).

A communication jack 100 is physically and electrically attached to the printed circuit board of the controller such that electrical impulses derived from a computer may be input to affect the controller as described in the computer communications portion of this application.

Controller Interface

The operator of the controller may interface with the controller by pressing various buttons or switches. The parameters are shown in a parameter section 102. A parameter display tactile membrane button 104 is pressed to select the specific parameter which is to be displayed.

The mode which the compressor is operating under is controlled by a modular control section 106 of the controller. An unload tactile button 108 is pressed to place the compressor in an unload mode. Depending on the number of times which a load switch 110 is pressed, the compressor is either placed in a specific mode of operation or the controller selects the most efficient mode of operation depending upon the operation of the compressor.

The setting of the functions controlled by the controller is regulated within a function section 109. The function which is desired to set can be selected by pressing the function set key 111. Once the desired function is set, the function set point may be altered by pressing function step buttons 112 and 114.

The compressor is programmed to turn itself off after a specific period after the operator has not used the compressor. At this time, an automatic restart indicator 116 will be on. When there is a call for air when the indicator is on, the controller will automatically restart the compressor.

COMPUTER INTERFACE

The use of jacks 100 connected to the controller permits the control and analysis of the controller to originate not only from the operator, but also from a computer 118.

In this manner, the computer overrides the independent response of the controller to the parameters wherein the controller acts in response to the computer.

During the analysis of the controller during manufacturing or after long continued use of the controller, the computer will generate a series of electrical signals which will simulate various known parameters and functions which might be fed to the controller. If the controller displays inconsistent readings or outputs from the output signals, then the inspector will know that the controller is defective.

The computer signal 150 which is generated to each controller contains a plurality of segments. A start of transmission segment 152 which signals to all of the controllers connected to the computer that the transmission is about to begin. The next segment is a destination address 154 which indicates those controllers that should obey the remainder of the signal.

The third segment of the signal is a source address 156 which indicates computer the signal originated from. Since the controller may be programmed to listen to only certain signals, if the source address is incorrect, the controller will not obey a command segment 160 of the signal. Next, a length segment 158 of the signal alerts the controllers how many bytes there will be in the signal.

The command segment 160 and a data segment 162 combine to tell the specified controller what it should do. The command segment indicates which mode or function the compressor 121, 123, 125 or 127 should operate in. The data segment, if needed for the specific signal, will indicate what temperature, pressure, or other parameter should be obtained by the compressor.

The check byte sum segment 164 sums the total of all the bytes given in the signal to the controller. If the check byte sum does not agree, then the computer and/or the controller will be alerted that it likely missed a portion of the command. The end of transmission segment indicates that the signal has ended.

The printed circuit board contains a plurality of input/output jacks 100 such that a plurality of controllers 120, 122, 124, 126, which each operate a separate compressor 121, 123, 125 and 127 can be individually controlled by a single signal from the computer 118. Due to the above signal from the computer, either a single compressor, or any number of compressors can be electrically coupled to operate from the signals from the computer 118.

The electrical wiring 166 which couples each controller to the computer will be identical. The computer is connected to transmission conductor 168 via a computer driver 172 which transmits a signal through conductor 168 to controller receivers 172, 174, 176, and 178 simultaneously. In response to the computer signal, each controller 120, 122, 124 and 126 can respond to each inquiring signal from the computer by generating a response signal through controller drivers 180, 182, 184 and 186 which travel through transmission conductor 168 to a computer receiver 188.

With this electrical wiring system 166 utilizing the previously described signal 150, the computer can ask each controller to state its immediate parameters or functions, such as the temperature, pressure that the controller is operating under or how long the individual controller has been operating in an unloaded state. The individual controller will respond to the controller with the requested information.

While this invention has been illustrated and described in accordance with a preferred embodiment, it is recognized that variations and changes may be made therein without departing from the invention as set forth in the claims.

What is claimed is:

1. An apparatus comprising:

compression means for compressing a fluid which includes a compressor inlet, a compressor element, a compressor sump and a compressor discharge;

a sensor capable of sensing at least one function which relates to the pressure of said compressor discharge;

control means, responsive to said sensor, capable of independently controlling said compression means to maintain said discharge pressure within a predetermined range, wherein provided a constant speed of the compressor element, the control means controls the discharge pressure by regulating flow of the fluid between the compressor inlet and the compressor sump; and computer means for overriding said independent control of said compression means by said control means.

2. The apparatus as described in claim 1, wherein the computer means is a microprocessor.

3. The apparatus as described in claim 1, wherein one of the functions is compressor discharge pressure.

4. The apparatus as described in claim 1, wherein one of the functions is compressor dishcarge temperature.

5. The apparatus as described in claim 1, wherein one of the functions is compressor sump pressure.

6. The apparatus as described in claim 1, wherein one of the functions is the difference between compressor sump and compressor discharge pressures.

7. The apparatus as described in claim 1, further comprising:

a pressure sensor which indicates to the controller a sensed pressure.

valve means which alternately applies pressure from the compressor inlet and the compressor sump to the controller means.

8. The apparatus as described in claim 1, wherein one of the parameters is compressor discharge pressure.

9. The apparatus as described in claim 1, wherein one of the parameters is pressure difference between the compressor discharge and compressor sump.

10. The apparatus as described in claim 1, wherein one of the parameters is automatic restart time which controls how long the period before restart will be after the compressor has been shut down.

11. The apparatus as described in claim 1, further comprising:

an unloaded stop switch which when actuated restricts fluid flow through the compressor inlet prior to shutting the compression means off.

12. The apparatus as described in claim 1, further comprising:

a transmission conductor connected between the control means and the computer means.

13. The apparatus as described in claim 1, wherein the computer is a sequencing computer, alternately controlling the operation of a plurality of controllers.

14. The apparatus as described in claim 13, wherein a signal will be transmitted from the computer to each of the plurality of controllers, and each controller has the capability of determining which portion of the signal applies to that controller.

15. The apparatus as described in claim 1, further comprising:

a host test computer which applies known parameters to the controller to test whether the controller responds properly to the known parameters.

16. The apparatus as described in claim 1, wherein a signal is transmitted from the computer to a controller.

17. The apparatus as described in claim 16, wherein the signal includes a destination portion.

18. The apparatus as described in claim 16, wherein the signal includes a task portion.

19. The apparatus as described in claim 16, wherein the signal includes a source address portion.

20. The apparatus as described in claim 16, wherein the signal includes a check byte sum portion.

21. The apparatus as described in claim 16, wherein the signal includes a length command portion.

22. The apparatus as described in claim 16, wherein the signal includes a start of transmission command portion.

23. The apparatus as described in claim 16, wherein the signal includes an end of transmission portion.

24. The apparatus as described in claim 16, wherein the signal includes a data command portion.

25. An apparatus for controlling a fluid compression system, comprising compression means for pressurizing fluid, the compression means includes an inlet, a compressor element and outlet and a sump;

control means for indicating operating parameters and functions of the compression means, graphically displaying the parameters and functions, setting limits of the parameters and controlling the compression means in response to any of the parameters reaching a preset level of a corresponding function wherein the compression means operates in a first mode in which, after a range is set for outlet pressure being defined by upper and lower outlet pressures limits, the control means will alter operation of the compression means causing the outlet pressure to return within the range when the pressure exceeds either of the limits; and the compression means operates in a second mode wherein, after the outlet pressure exceeds either of the limits, the control means will regulate flow of air to the compressor sump while the compressor element of the compression means maintains constant speed of the compressor element to regulate the outlet pressure wherein the control means determines which of the first and second modes is more efficient depending upon the operation of the compression means, and causes the compression means to operate in that mode;

26. The apparatus as described in claim 25, wherein when the control means is operating in the first mode of operation and the outlet pressure reaches the lower limit, the control means switches the compression means from an off line to an on line state.

27. The apparatus as described in claim 25, wherein when the compression means is in said first mode of operation, and the compression means cycles between an on line and an off line state for a predetermined number of cycles within a predetermined period, then the controller means switches the compression means to the second mode of operation.

* * * * *